US010265832B2

(12) United States Patent
Myl et al.

(10) Patent No.: US 10,265,832 B2
(45) Date of Patent: Apr. 23, 2019

(54) APPARATUS AND A PROCESS FOR GRINDING AN EDGE AND A GLAZING HAVING A GROUND EDGE

(71) Applicant: PILKINGTON GROUP LIMITED, Lancashire (GB)

(72) Inventors: Lukasz Myl, Sandomierz (PL); Sebastian Hablasek, Wilczyce (PL)

(73) Assignee: PILKINGTON GROUP LIMITED, Nr. Ormskirk, Lancashire (GB)

( * ) Notice: Subject to any disclaimer, the term of this patent is extended or adjusted under 35 U.S.C. 154(b) by 32 days.

(21) Appl. No.: 15/519,269

(22) PCT Filed: Oct. 13, 2015

(86) PCT No.: PCT/GB2015/052998
§ 371 (c)(1),
(2) Date: Apr. 14, 2017

(87) PCT Pub. No.: WO2016/059389
PCT Pub. Date: Apr. 21, 2016

(65) Prior Publication Data

US 2017/0225293 A1 Aug. 10, 2017

(30) Foreign Application Priority Data

Oct. 14, 2014 (GB) ..... 1418175.4

(51) Int. Cl.
*B24B 5/02* (2006.01)
*B24B 55/03* (2006.01)
(Continued)

(52) U.S. Cl.
CPC ..... *B24B 55/03* (2013.01); *B24B 9/10* (2013.01); *B24B 55/045* (2013.01)

(58) Field of Classification Search
CPC ..... B24B 55/03; B24B 9/10; B24B 49/14; B24B 55/02; B24B 55/045; B24B 55/12;
(Continued)

(56) References Cited

U.S. PATENT DOCUMENTS 4,344,260 A * 8/1982 Ogiwara ..... B24B 9/065 148/33
4,667,443 A 5/1987 Sakurai et al.
(Continued)

FOREIGN PATENT DOCUMENTS

CN 203418389 U 2/2014
EP 1 413 397 A1 4/2004
(Continued)

OTHER PUBLICATIONS

British Search Report dated Mar. 24, 2015 issued by the British Intellectual Property Office in corresponding British Patent Application No. GB1418175.4 (4 pages).
(Continued)

*Primary Examiner* — George B Nguyen
(74) *Attorney, Agent, or Firm* — Buchanan Ingersoll & Rooney PC

(57) ABSTRACT

An apparatus for edge grinding a glazing comprising a grinding wheel, rotatable about an axis, a groove in a circumference of the wheel and first and second orifices arranged on first and second sides of the plane of the groove, which form first and second jets of coolant directed substantially into the groove on first and second trajectories not in the plane of the groove. A corresponding process for edge grinding causes fewer sharp portions and fewer small fractures in the glazing edge than the prior art. A glazing manufactured by the apparatus or the process has higher edge strength than the prior art.

14 Claims, 3 Drawing Sheets

(51) Int. Cl.
*B24B 55/04* (2006.01)
*B24B 9/10* (2006.01)

(58) Field of Classification Search
CPC .. B23Q 11/10; B23Q 11/1007; B23Q 11/1015
USPC ..... 451/44
See application file for complete search history.

(56) References Cited

U.S. PATENT DOCUMENTS

| | | | | |
|---|---|---|---|---|
| 4,739,586 | A * | 4/1988 | Eckardt | B23Q 11/1084 451/251 |
| 5,317,836 | A * | 6/1994 | Hasegawa | B23Q 1/36 257/E21.237 |
| 5,713,784 | A | 2/1998 | Miller | |
| 6,196,902 | B1 | 3/2001 | Gazca-Ortiz et al. | |
| 6,306,015 | B1 * | 10/2001 | Bushell | B24B 1/00 451/44 |
| 6,398,629 | B1 * | 6/2002 | Bavelloni | B24B 9/085 451/194 |
| 6,669,532 | B1 * | 12/2003 | Mukai | B23Q 11/10 451/449 |
| 6,962,521 | B2 * | 11/2005 | Mizushima | B24B 9/065 257/E21.237 |
| 7,364,494 | B2 * | 4/2008 | Takeichi | B24B 9/14 451/43 |
| 9,409,271 | B2 * | 8/2016 | Wolgram | B24B 55/03 |
| 2004/0118457 | A1 * | 6/2004 | Sugata | B23Q 39/023 137/434 |
| 2008/0318502 | A1 | 12/2008 | Schrottner | |
| 2011/0005729 | A1 * | 1/2011 | Stemke | B29C 33/046 165/104.26 |
| 2011/0318123 | A1 * | 12/2011 | Leishman | B23Q 11/10 408/1 R |
| 2016/0318152 | A1 * | 11/2016 | Jang | B24B 55/02 |

FOREIGN PATENT DOCUMENTS

| | | | |
|---|---|---|---|
| JP | 2003-266306 | A | 9/2003 |
| JP | 2010-058265 | A | 3/2010 |
| WO | WO 03/076132 | A1 | 9/2003 |
| WO | WO 2003/080290 | A1 | 10/2003 |
| WO | WO 2009/081637 | A1 | 7/2009 |
| WO | WO 2012/073626 | A1 | 6/2012 |

OTHER PUBLICATIONS

International Search Report (PCT/ISA/210) dated Feb. 11, 2016, by the European Patent Office as the International Searching Authority for International Application No. PCT/GB2015/052998.
Written Opinion (PCT/ISA/237) dated Feb. 11, 2016, by the European Patent Office as the International Searching Authority for International Application No. PCT/GB2015/052998.

* cited by examiner

APPARATUS AND A PROCESS FOR GRINDING AN EDGE AND A GLAZING HAVING A GROUND EDGE

BACKGROUND OF THE INVENTION

The invention is concerned with an apparatus and a process for edge processing of a glazing, and a glazing, such as an automotive glazing, comprising a processed edge.

It is known in the field of processing glass panes, such as vehicle windscreens, to provide a processed edge using a rotating wheel, such as a grinding wheel. A wheel suitable for glass panes has an annular groove in its circumference, having a shape corresponding to a desired edge shape of the glass pane. A glass pane is arranged in a plane of the annular groove and is brought into contact with the groove, to define a contact region. As the contact region moves along the groove, glass material is removed by grinding. An orifice such as a nozzle is provided to supply coolant to the glass pane.

U.S. Pat. No. 4,739,586 (Eckardt/Flachglas) discloses two coolant jets arranged in a plane of a groove, for injecting coolant tangentially into the groove, so that a contact region receives coolant from both directions along the groove. Coolant is injected in a fine jet so that a relatively limited quantity of coolant is required.

U.S. Pat. No. 4,667,443 (Sakurai/NSG) discloses a single nozzle arranged above a glass pane, for injecting coolant to an edge of the pane. Grinding pressure is controlled to provide a glazing having a desired edge shape and a uniform margin. Examples of edge shape are chamfered and U-shaped. An example of a glass pane is a windshield glass of a vehicle.

U.S. Pat. No. 5,713,784 (Miller) and U.S. Pat. No. 6,287,176 (Volgt/Wendt) both disclose a water container for supplying cooling water to a grinding region via a nozzle, or a series of nozzles, arranged only on one side of a plane of a groove in a grinding wheel.

WO2003080290A1 (Collins/AP-Technoglass) discloses a single nozzle for directing coolant generally towards an edge processing wheel. The coolant further serves to lubricate a contact region. Edge processing is said to have three benefits (a) to remove sharp portions ('burrs') of an edge which could cause injury when handling a glass pane, (b) to reduce small fractures in the edge that could otherwise cause shattering of the glass pane and (c) to produce an aesthetically pleasing product.

JP2003266306A, WO2003076132A1 and JP2010058265A (Bando/Bando) disclose a container for supplying coolant via first and second series of holes. The first series of holes is arranged perpendicular to the glazing for supplying coolant to the glazing, in a region adjacent to a contact region where the glazing contacts a grinding wheel. The second set of holes is arranged in a plane of a groove in a circumference of the grinding wheel for supplying coolant to the groove.

U.S. Pat. No. 6,196,902 (Gazca-Ortiz/Vidrio) discloses an apparatus for processing an edge of an automotive glazing, having a grinding wheel and a means for distributing a cooling fluid, which comprises two tubes arranged on opposite sides of the wheel, each having a plurality of holes. The holes are for projecting coolant fluid towards the periphery and lower and upper surfaces of the wheel. Cooling fluid is preferably projected as a spray or a mist. Spray is said to be an improvement over a flow of water, because a spray prevents glass being stained with debris from grinding, which is carried over an edge of the glass by the flow of water.

There remains a need for an alternative apparatus and an alternative process for edge processing to achieve the above-mentioned benefits in a corresponding product.

STATEMENT OF INVENTION

According to the present invention from a first aspect, an apparatus is provided comprising the features set out in claim 1 attached hereto.

The present invention provides at least two orifices at least one on each side of the plane of a groove, arranged to form at least two jets of coolant directed substantially into the groove, on trajectories not in the plane of the groove. Surprisingly, the inventors have found that said arrangement results in longer uptime of an apparatus for edge processing. It also causes greater efficiency of a process for manufacturing a glazing and causes higher strength of a glazing product comprising a processed edge.

The inventors have found that using one or two orifices according to the prior art in which coolant is injected generally in the direction along a groove, or as a mist, fails to remove all debris from the contact region. It is believed that debris remaining in the contact region causes further small fractures, which reduces edge strength of a glazing. Reduced edge strength causes breakage during further processing, such as toughening, or in service, related to thermal shock. Surprisingly, the inventors have found that arranging two orifices not in the plane of the groove according to the invention causes fewer fractures in the glazing edge than the prior art.

In an advantageous embodiment, at least two orifices are arranged to direct jets of coolant substantially into a contact region, providing improved penetration of coolant into the contact region, so small fractures are almost completely eliminated. Thus in-service failures of the glazing are significantly reduced compared with the prior art.

Preferably, the groove and the glazing are arranged to define a contact region and the first and second jets of coolant are directed substantially into the contact region.

The inventors have found that arranging at least two orifices not in the plane of the groove and at angles to said plane in specific ranges according to the invention results in reduced wear of edge processing wheels. Apparatus uptime is thus increased because wheels need to be changed less often than in the prior art, in which fine sprays of a relatively limited amount of coolant are injected tangentially along a groove. It is believed that by injecting coolant along the groove, the prior art fails to lubricate all contact surfaces of the contact region.

Preferably, the apparatus comprises a first series of orifices arranged on the first side of the plane of the groove to form a first series of jets of coolant and comprises a second series of orifices arranged on the second side of the plane of the groove to form a second series of jets of coolant, wherein said jets are directed substantially into the groove on trajectories not in the plane of the groove.

Preferably, the apparatus further comprises first and second containers, for containing coolant and for supplying coolant to the orifices, arranged on the first and second sides of the plane of the groove.

Preferably, the first and second containers extend parallel to the wheel around a half of the circumference of the wheel or less, more preferably a quarter of the circumference of the wheel or less. These embodiments are advantageous for easier fitting of the second container to an existing machine having only a first container. Down-time for maintenance, such as cleaning the orifices is also reduced.

Preferably, first and second containers are connected by at least one conduit suitable for supplying coolant from the first container to the second container, forming an assembly comprising a single inlet and no outlets except the orifices. The conduit provides coolant at substantially equal pressure to first and second sets of orifices, thus providing more uniform cooling for different diameters of grinding wheel. An advantage of the invention is that the apparatus cools and lubricates a grinding wheel, independent of the diameter of the wheel. When replacing a worn wheel with a new wheel, having larger diameter, an operator does not need to adjust the apparatus for optimum coolant flow, so set-up time is reduced compared with the prior art.

Preferably, the orifices are arranged in a range from 5 degrees to 45 degrees, more preferably 10 degrees to 20 degrees, with respect to the plane of the groove.

Preferably, orifice diameters are in a range from 1 mm to 5 mm. These embodiments form jets of coolant directed substantially into the groove on linear trajectories for optimal lubrication of the groove.

Preferably, the glazing is automotive glazing having thickness in a range from 2 mm to 6 mm. The inventors have found that at least two jets of coolant arranged according to the invention result in better removal of heat from the grinding wheel during the grinding process and better removal of debris from the surfaces of an automotive glazing in the said thickness range. A higher quality of glass edge is achieved than in the prior art.

According to the present invention from a second aspect, a process for manufacturing a glazing is provided, comprising the steps set out in claim 10 attached hereto.

Surprisingly, the inventors have found that a process for manufacturing a glazing according to the invention has a shorter cycle time than the prior art. The inventors have found that cooling effect of the coolant is greater than the prior art, so grinding can be performed faster.

Preferably the process further comprises the step of arranging the groove and the glazing to define a contact region and at least two jets of coolant are directed substantially into the contact region.

Preferably, the process further comprises the steps:

- arranging a first series of orifices on the first side of the plane of the groove to form a first series of jets of coolant
- arranging a second series of orifices on the second side of the plane of the groove to form a second series of jets of coolant
- wherein said jets are directed substantially into the groove and on trajectories not in the plane of the groove.

Preferably, the process further comprises the steps:

- arranging first and second containers, for containing coolant and for supplying coolant to the orifices, on the first and second sides of the plane of the groove
- providing at least one conduit connecting the first and second containers, suitable for supplying coolant from the first container to the second container, forming an assembly comprising a single inlet and no outlets except for the orifices.

Preferably the process further comprises the step of arranging the orifices in a range from 5 degrees to 45 degrees, more preferably from 10 degrees to 20 degrees, with respect to the plane of the groove.

Preferably, the process is further characterised in that orifice diameters are in a range from 1 mm to 5 mm.

Preferably, the process is further characterised in that the glazing is automotive glazing having thickness in a range from 2 mm to 6 mm, laminated or monolithic.

According to the present invention from a third aspect, a glazing is provided, comprising the features set out in claim 15 attached hereto.

A V-shaped edge is also known as a chamfered edge. It is understood that U-shaped, C-shaped and V-shaped also include edges which are asymmetric.

Surprisingly, the inventors have found that a glazing according to the invention has a high quality of edge smoothness compared with a glazing of the prior art. Thus edge strength is higher and the glazing does not break due to thermal shock in further processing, such as toughening, or in-service.

BRIEF DESCRIPTION OF THE DRAWINGS

The invention will now be described by means of non-limiting examples with reference to the attached figures.

DETAILED DESCRIPTION OF THE INVENTION

Although the invention is described herein with particular reference to an automotive windscreen, it will be understood that it has applications to other vehicle glazing, for example a rear window or a side window.

Figure 1:
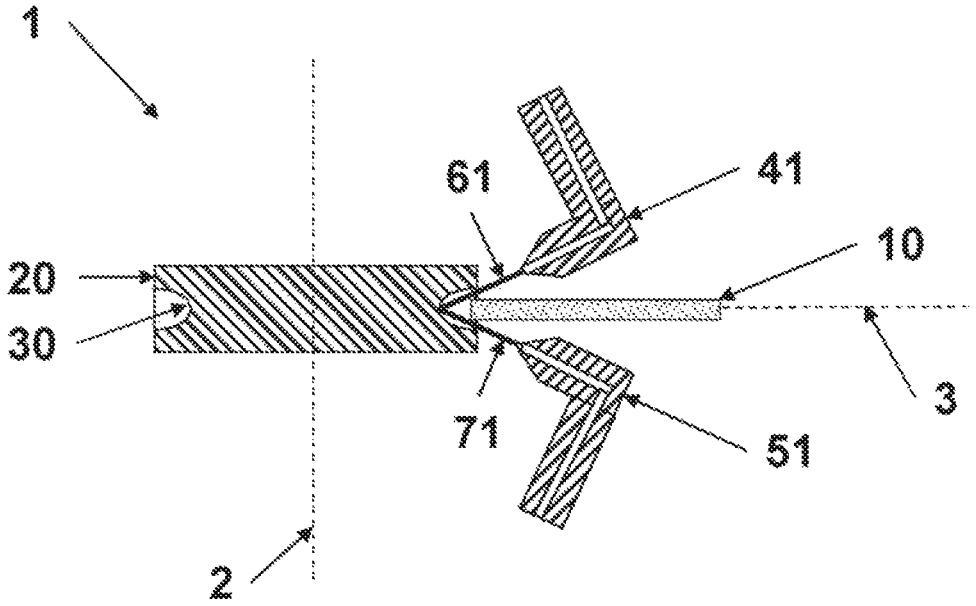
FIG. 1 shows an apparatus and a glazing according to the invention in cross-section in a plane containing an axis of rotation of a wheel.

FIG. 1 shows an apparatus 1 for edge grinding of a glazing 10. The apparatus comprises a wheel 20 which rotates about an axis 2. A groove 30 in a circumference of the wheel is in a plane 3 perpendicular to the axis 2 of rotation. First and second orifices 41, 51 are arranged so as to direct first and second jets 61, 71 of coolant into the groove 30.

In an embodiment, first and second orifices 41, 51 are arranged on first and second sides of the plane 3 of the groove for projecting coolant. First and second orifices are arranged to form jets 61, 71 of coolant directed substantially into the groove 30 on first and second trajectories not in the plane 3 of the groove.

Figure 2:
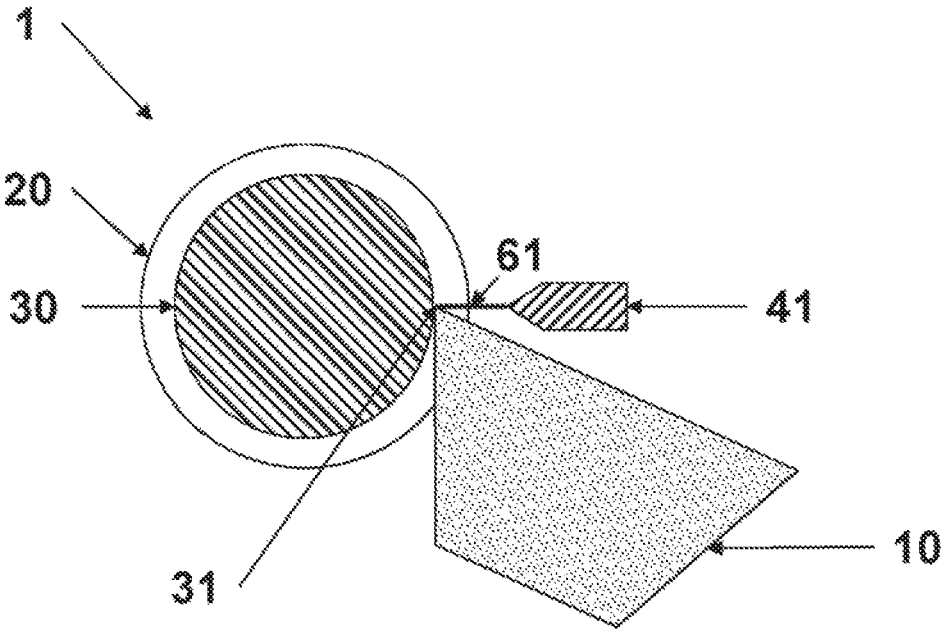
FIG. 2 shows an apparatus and a glazing according to the invention in the plane of the groove, showing a groove and a glazing defining a contact region.

FIG. 2 shows an advantageous embodiment, where the groove 30 contacts the glazing 10 to define a contact region 31, and at least one orifice 41 is arranged to direct at least one jet 61 of coolant into the groove 30 to improve removal of debris and for further cooling.

Figure 3:
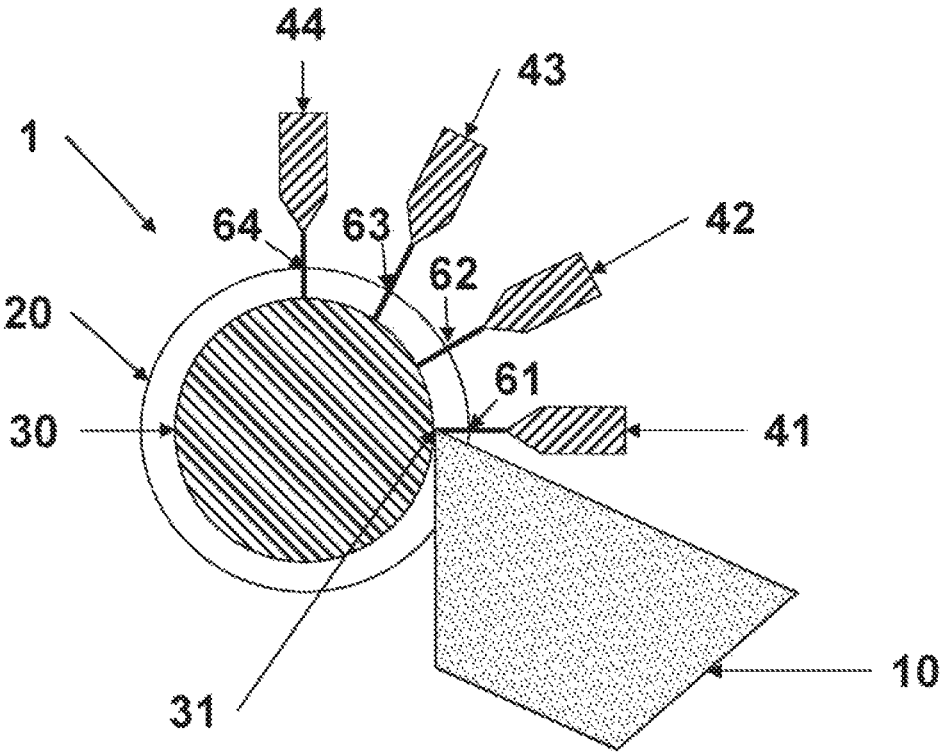
FIG. 3 shows an apparatus and a glazing according to the invention having a first series of orifices and a first series of jets of coolant.

FIG. 3 shows an advantageous embodiment, in which a first series of orifices 41, 42, 43, 44 are arranged on a first side of the plane 3 of the groove to form a first series of jets 61, 62, 63, 64 of coolant.

Figure 4:
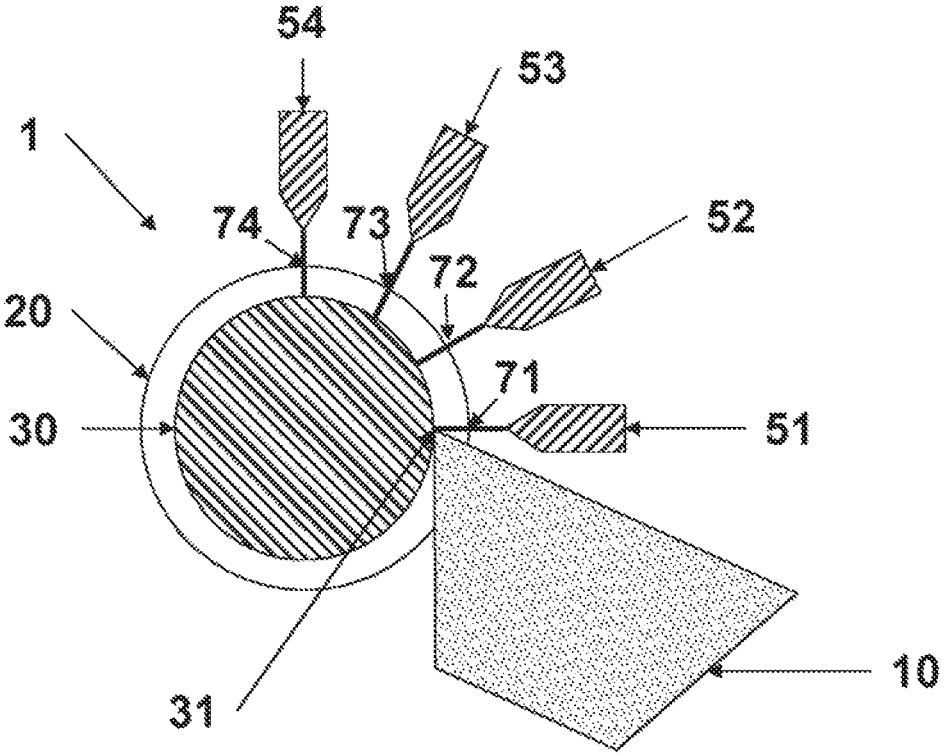
FIG. 4 shows an apparatus and a glazing according to the invention having a second series of orifices and a second series of jets of coolant.

FIG. 4 shows a second series of orifices 51, 52, 53, 54 arranged on a second side of the plane 3 of the groove to form a second series of jets 71, 72, 73, 74 of coolant.

Figure 5:
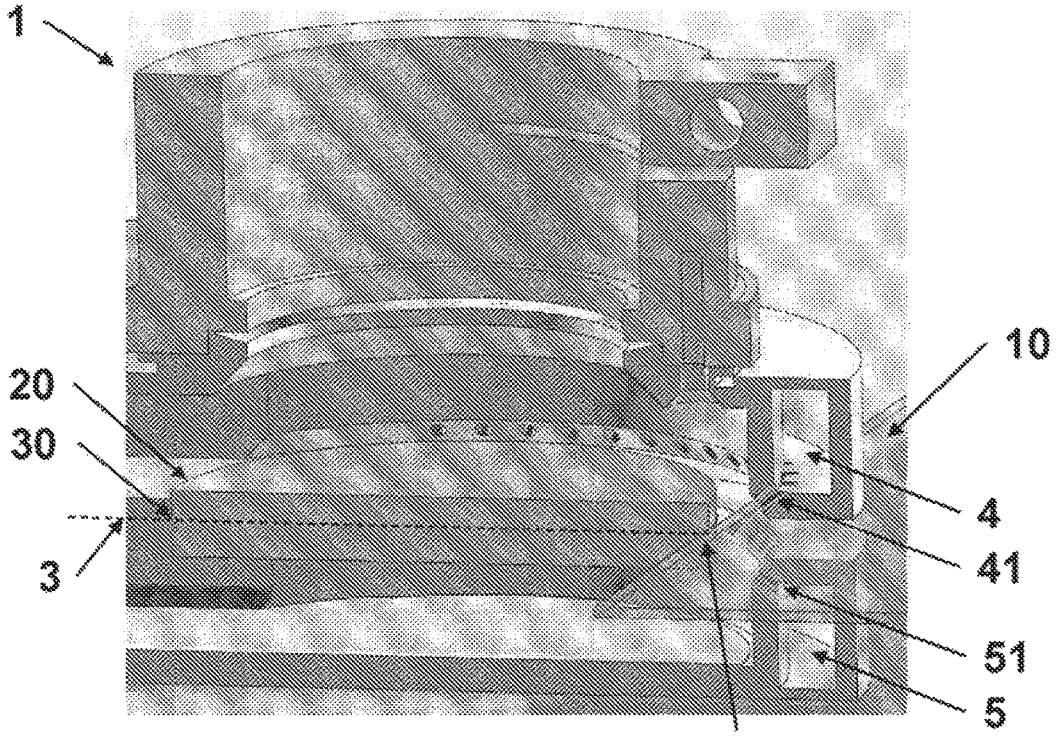
FIG. 5 shows an apparatus and a glazing according to the invention in isometric view and in cross-section in a plane containing an axis of rotation of a wheel.

FIG. 5 shows a cross-section of the apparatus 1 for edge grinding a glazing 10. First and second containers 4, 5 are provided for containing coolant and for supplying coolant to the orifices, said containers arranged on the first and second sides of the plane 3 of the groove. The first and second containers 4, 5 extend parallel to a half of the circumference of the wheel 20 or less, more preferably a quarter of the circumference or less.

Figure 6:
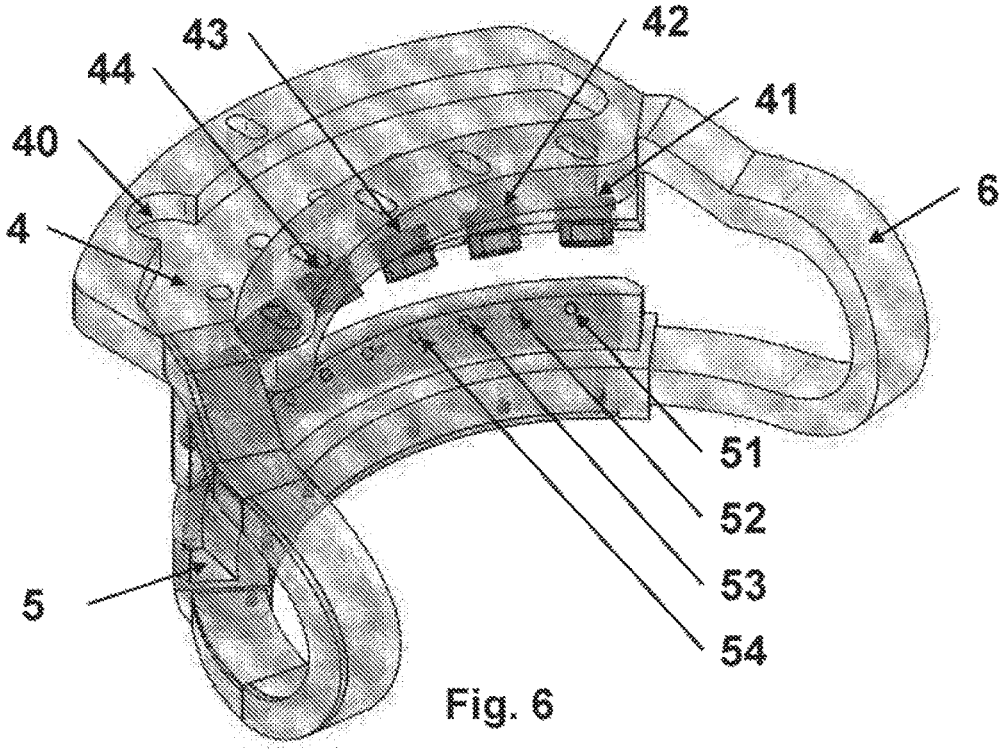
FIG. 6 shows first and second containers for containing coolant, each comprising a series of orifices and connected by a conduit, according to the invention.

FIG. 6 shows an advantageous embodiment in which the first and second containers 4, 5 are connected by at least one conduit 6 suitable for supplying coolant from the first container 4 to the second container 5, forming an assembly comprising a single inlet 40 and no outlets except for the orifices.

Advantageously, an assembly having two series of orifices according to the invention can be retrofitted to an apparatus of the prior art, having only a first container and a first series of orifices. Two conduits 6 may be provided, so as to equalise pressure at both ends of the first and second containers 4, 5.

EXAMPLES OF THE INVENTION

Glazings were prepared according to the invention, by means of an apparatus having a grinding wheel comprising a groove, further comprising first and second series of orifices arranged on first and second sides of the plane of the groove. Orifices were arranged to form first and second series of jets of coolant, directed substantially into the groove on trajectories not in the plane of the groove.

The inventors have found that good cooling of the wheel and cleaning of the groove are achievable if orifices are arranged to form jets of coolant on a series of trajectories in a range from 5 degrees to 45 degrees with respect to the plane of the groove. Optimal cleaning is achieved in a range from 10 degrees to 20 degrees.

Optimal orifice diameters are in a range from 1 mm to 5 mm. Orifices can be holes in the walls of coolant containers, or may be nozzles, which can be unscrewed to allow easier cleaning of an orifice.

In comparative examples, edges of automotive glazing having thickness in a range 2 mm to 6 mm were introduced into an apparatus similar to the one described above, but having only one series of orifices. Automotive glazings manufactured by an apparatus and a process according to the invention were found to have fewer sharp portions and fewer small fractures than the comparative examples. Edge strength was higher than the prior art such that there were fewer breakages of glazing during manufacture and therefore higher process yield.

The invention claimed is:

1. An apparatus for edge grinding of a glazing, comprising:

a wheel suitable for grinding an edge of the glazing rotatable about an axis, a groove in a circumference of the wheel such that a plane of the groove is perpendicular to the axis of rotation, first and second orifices arranged on first and second sides of the plane of the groove, suitable for projecting coolant, the first and second orifices being arranged to form first and second jets of coolant directed substantially into the groove on first and second trajectories not in the plane of the groove, the groove and the glazing being arranged to define a contact region and the first and second lets of coolant are directed substantially into the contact region.

2. An apparatus according to claim 1, comprising:

a first series of orifices arranged on the first side of the plane of the groove to form a first series of jets of coolant, a second series of orifices arranged on the second side of the plane of the groove to form a second series of jets of coolant, wherein said jets are directed substantially into the groove on trajectories not in the plane of the groove.

3. An apparatus according to claim 1, further comprising first and second containers for containing coolant and for supplying coolant to the orifices, arranged on the first and second sides of the plane of the groove.

4. An apparatus according to claim 3, wherein the first and second containers extend parallel to a half of the circumference of the wheel or less, more preferably a quarter of the circumference or less.

5. An apparatus according to claim 3, wherein the first and second containers are connected by at least one conduit suitable for supplying coolant from the first container to the second container, forming an assembly comprising a single inlet and no outlets except for the orifices.

6. An apparatus according to claim 1, wherein orifices are arranged in a range from 5 degrees to 45 degrees with respect to the plane of the groove.

7. An apparatus according to claim 1, wherein orifice diameters are in a range from 1 mm to 5 mm.

8. An apparatus according to claim 1, wherein the glazing is an automotive glazing having thickness in a range from 2 mm to 6 mm.

9. An automotive glazing manufactured by the apparatus of claim 1, wherein an edge shape is U-shaped, C-shaped or V-shaped.

10. An apparatus according to claim 1, wherein orifices are arranged in a range from 10 degrees to 20 degrees with respect to the plane of the groove.

11. A process for manufacturing a glazing comprising:

providing an apparatus comprising a wheel suitable for grinding an edge of the glazing rotatable about an axis;

providing a groove in a circumference of the wheel such that a plane of the groove is perpendicular to the axis of rotation;

providing first and second orifices, arranged on first and second sides of the plane of the groove, suitable for projecting coolant;

arranging the first and second orifices to form first and second jets of coolant directed substantially into the groove on first and second trajectories not in the plane of the groove; and arranging the groove and the glazing to define a contact region and the first and second jets of coolant are directed substantially into the contact region.

12. A process according to claim 11, comprising:

arranging a first series of orifices on the first side of the plane of the groove to form a first series of jets of coolant;

arranging a second series of orifices on the second side of the plane of the groove to form a second series of jets of coolant;

wherein said jets are directed substantially into the groove and on trajectories not in the plane of the groove.

13. A process according to claim 11, comprising:

arranging first and second containers, for containing coolant and for supplying coolant to the orifices, on the first and second sides of the plane of the groove;

providing at least one conduit connecting the first and second containers, suitable for supplying coolant from the first container to the second container, forming an assembly comprising a single inlet and no outlets except for the orifices.

14. A process according to claim 11, wherein the glazing is an automotive glazing having thickness in a range from 2 mm to 6 mm.

* * * * *